US006481872B1

(12) United States Patent
Hayashi et al.

(10) Patent No.: US 6,481,872 B1
(45) Date of Patent: Nov. 19, 2002

(54) ASTRAL LAMP

(75) Inventors: Yasuo Hayashi, Yokohama (JP); Toshihiko Seki, Yokohama (JP)

(73) Assignee: Koito Industries, Ltd. (JP)

( * ) Notice: Subject to any disclaimer, the term of this patent is extended or adjusted under 35 U.S.C. 154(b) by 0 days.

(21) Appl. No.: 09/420,749

(22) Filed: Oct. 20, 1999

(30) Foreign Application Priority Data

Oct. 22, 1998 (JP) ..... 10-300862

(51) Int. Cl.[7] ..... F21V 7/00
(52) U.S. Cl. ..... 362/297; 362/346; 362/804
(58) Field of Search ..... 362/33, 297, 346, 362/347, 348, 343, 350, 804

(56) References Cited

U.S. PATENT DOCUMENTS

| | | | | |
|---|---|---|---|---|
| 4,153,929 A | | 5/1979 | Laudenschlarger et al. | 362/248 |
| 4,459,647 A | | 7/1984 | Yamauchi et al. | 362/297 |
| 5,034,867 A | * | 7/1991 | Mayer | 362/297 |
| 5,199,785 A | | 4/1993 | Scholz | 362/296 |
| 5,971,569 A | * | 10/1999 | Smith et al. | 362/804 |

FOREIGN PATENT DOCUMENTS

| | | |
|---|---|---|
| JP | 60-31695 | 9/1985 |
| JP | 61-25123 | 7/1986 |
| JP | 2-65856 | 3/1990 |
| JP | 3-88215 | 9/1991 |

* cited by examiner

*Primary Examiner*—Y. My Quach-Lee
(74) *Attorney, Agent, or Firm*—Blakely Sokoloff Taylor & Zafman

(57) ABSTRACT

An astral lamp includes a light source and a concave mirror. The concave mirror reflects light emitted by the light source and condenses the reflected light on a light source side toward an illumination area remote from the light source. The concave mirror is constituted by a plurality of concave mirror surfaces that form one parabolic mirror of revolution as a whole. The mirror surfaces respectively have curved surfaces for separately reflecting the light emitted by the light source and condensing the reflected light toward an entire portion of the illumination area.

5 Claims, 15 Drawing Sheets

ASTRAL LAMP

BACKGROUND OF THE INVENTION

The present invention relates to an illumination unit and, more particularly, to an astral lamp used in dental and other medical treatments.

An illumination unit used in dental and other medical treatments is designed to avoid generation of a shadow in the illumination area, and is accordingly usually called an astral lamp. As shown in FIG. 26, an astral lamp of this type has a heat-resistant-glass reflecting mirror, in this case, a parabolic mirror 52 of revolution, an arm 59, a protection cover 57, a light source light-shielding cylinder 58, and a light source 51. The parabolic mirror 52 has a plurality of segments 53 made of flat mirrors. The arm 59 supports the parabolic mirror 52. The light source 51 is comprised of a linear halogen lamp or other linear light source, and will be referred to as a linear light source hereinafter. Generally, the linear light source 51 is arranged in front of the focal point of the parabolic mirror 52.

The parabolic mirror 52 of revolution is formed into a concave mirror along a concave paraboloid of revolution formed by rotating a predetermined parabola about its vertex as the center. The parabolic mirror 52 reflects light emitted by the linear light source 51 toward the linear light source 51 to form a light path 55. The light path 55 condenses light toward a predetermined illumination area 56 remote from the linear light source 51, thereby irradiating only the specific portion, i.e., morbid portion of a patient. Even if the linear light source 51, the doctor's hand, or other light-shielding object enters the light path 55 to partially block light, the light path 55 must be able to ensure a high shadowless degree and illumination uniformity. A "shadowless degree" is a degree with which, even if a light-shielding object enters a light path having a predetermined illumination area, a shadow image is not formed in the illumination area. An "illumination uniformity" is a degree with which the reflected light beam is diffused uniformly and theoretically within the illumination area.

The size of the illumination area 56 of the light path 55 is determined by the position of the linear light source 51. More specifically, when the linear light source 51 is arranged at the focal position of the parabolic mirror 52, the light beam reflected by the parabolic mirror 52 forms parallel light substantially parallel to the axis of rotation of the paraboloid of revolution, i.e., the optical axis of the parabolic mirror 52, so that the size of the illumination area 56 becomes substantially equal to or larger than the opening area of the parabolic mirror 52. When the linear light source 51 is arranged behind the focal position, the reflected light beam is diffused, and the size of the illumination area 56 becomes larger than the opening area of the parabolic mirror 52. Inversely, when the linear light source 51 is arranged in front of the focal position, the reflected light beam is condensed, and the size of the illumination area 56 becomes smaller than the opening area of the parabolic mirror 52.

Usually, when an astral lamp is used for dental treatment, the linear light source 51 is arranged in front of the focal point to reduce the light path 55 toward a desired illumination area 56 smaller than the parabolic mirror 52.

As the reflecting mirror of such an astral lamp, various types are conventionally proposed, and among them, prior arts disclosed in Japanese Utility Model Publication Nos. 61-25123 and 60-31695, Japanese Utility Model Laid-Open No. 3-88215, and the like are known.

In a reflecting mirror for an astral lamp described in Japanese Utility Model Publication No. 61-25123 (to be referred to as prior art 1 hereinafter), as shown in FIG. 27, in order to obtain a high shadowless degree and illumination uniformity, a large number of segments 53 formed of rectangular flat mirrors are formed on the fundamental paraboloid of a parabolic mirror 52 of revolution divisionally in the direction of the major axis of the parabolic mirror 52 of revolution. Each rectangular flat mirror segment 53 has a long side coinciding with the minor axis of the fundamental paraboloid. The short width of each segment is set to a value corresponding to the major-axis width of the light path formed by the astral lamp.

In a reflecting mirror for an astral lamp described in Japanese Utility Model Publication No. 60-31695 (to be referred to as prior art 2 hereinafter), in order to similarly obtain a high shadowless degree and illumination uniformity, a large number of segments formed of flat mirrors are formed on the fundamental paraboloid of a parabolic mirror of revolution divisionally in the main direction (major-axis direction) and the subdirection (minor-axis direction) of the parabolic mirror of revolution. The long and short widths of each segment are set to values respectively corresponding to the major- and minor-axis widths of the light path. In other words, each segment is formed into such a size that it can diffuse the reflected light beam to reach the illumination area of the light path.

In an astral lamp described in Japanese Utility Model Laid-Open No. 3-88215 (to be referred to as prior art 3 hereinafter), in order to diverge the light in the subdirection and main direction, a large number of convex reflecting surfaces are aligned on the inner surface of a parabolic mirror of revolution or elliptic mirror of revolution in the main direction and subdirection. The vertical width (short width) of each convex reflecting surface is set smaller than the horizontal width (long width) thereof.

As another conventional unit, an astral lamp for dental treatment disclosed in Japanese Patent Laid-Open No. 2-65856 (to be referred to as prior art 4 hereinafter) is known. According to this prior art 4, the reflecting mirror is constituted by a curved surface portion corresponding to an operation field and having a function of condensing light to increase the luminous intensity, and a curved surface portion corresponding to a peripheral part of the operation field and having a function of dispersing light to lower the luminous intensity. The curved surface portion having the condensing function is formed of a spherical surface, a paraboloid, an ellipsoid of revolution, or the like. The curved surface portion having the light dispersing function is formed of a spherical surface having a radius larger than that of the curved surface portion having the condensing function.

Any one of the conventional prior arts 1 to 4 is still insufficient to obtain a high shadowless degree and illumination uniformity.

In prior art 1, as shown in FIG. 28, a fundamental paraboloid 54 that forms the inner surface of the parabolic mirror 52 is a paraboloid of revolution having a constant focal point, e.g., a focal length Fa. A plurality of segments 53 formed of flat mirrors are formed on the fundamental paraboloid 54 divisionally in the main direction of the fundamental paraboloid 54. Each segment 53 forms a paraboloid identical to the fundamental paraboloid 54 in the direction of the long side.

Light reflected by any point of the parabolic mirror 52 must form an illumination area, even at a position far from the parabolic mirror 52, to have a desired width smaller than the sub-direction width of the parabolic mirror 52, and condense the reflected light toward the illumination area at high precision. However, since each segment 53 is formed along one fundamental paraboloid 54 in its long-side direction, these two requirements cannot be satisfied.

In FIG. 28, the segment 53 is formed by using the fundamental paraboloid 54 that enables light reflected by any point of the parabolic mirror 52 to have a desired width in the subdirection within the illumination area far from the parabolic mirror 52. When, however, compared to an illumination area 56*c* formed by reflected light 55*c* reflected at an arbitrary point P3 on the segment 53 which is far from a linear light source 51, an illumination area 56*a* formed by light 55*a* reflected at an arbitrary point P1 near the linear light source 51 is undesirably shifted downward. Although FIG. 28 shows only the upper half of the parabolic mirror 52, in the lower half, the reflected light is shifted upward, in the opposite manner to that described above. Accordingly, the luminous intensity of the illumination area is highest at the central portion and decreases upward and downward. A high shadowless degree cannot be obtained, and the illumination area cannot be irradiated at a high illumination uniformity.

Prior art 2 is different from prior art 1 in that the plurality of segments formed of flat mirrors are formed on the fundamental paraboloid of the parabolic mirror of revolution divisionally in the main direction and subdirection. In this structure as well, the fundamental paraboloid of the parabolic mirror of revolution is formed by using one paraboloid having a predetermined focal length. If each reflected light beam is to have a desired width in the subdirection within the illumination area in the same manner as in prior art 1, the reflected light is undesirably shifted in the subdirection. As a result, the illumination area cannot be irradiated at a high illumination uniformity.

In prior art 3, light diverges in the horizontal and vertical directions by a large number of convex reflecting surfaces, so that a large illumination area is obtained. Accordingly, the luminous intensity of the illumination area decreases.

Prior art 4 is different from prior arts 1 and 2 described above in that the curved surface portion having the function of condensing light to increase the luminous intensity of the operation area is formed of merely a spherical surface, a paraboloid, an ellipsoid of revolution, or the like, and is not divided. However, since the radius of curvature or focal length of the curved surface portion is constant, the reflected light is undesirably shifted, in the same manner as in prior arts 1 and 2, and the illumination area cannot be irradiated at a high illumination uniformity.

SUMMARY OF THE INVENTION

The present invention has been made to solve the conventional problems described above, and has as its object to provide an astral lamp which can condense light reflected at different points toward a desired illumination area efficiently, so that a high shadowless degree and illumination uniformity can be obtained.

In order to achieve the above object, according to the present invention, there is provided an astral lamp comprising a light source and a concave mirror for reflecting light emitted by the light source and condensing the reflected light on a light source side toward an illumination area remote from the light source, the concave mirror being constituted by a plurality of concave mirror surfaces that form one parabolic mirror of revolution as a whole, and the mirror surfaces respectively having curved surfaces for separately reflecting the light emitted by the light source and condensing the reflected light toward an entire portion of the illumination area.

DESCRIPTION OF THE PREFERRED EMBODIMENTS

The present invention will be described in detail by way of embodiments shown in the accompanying drawings.

Figure 1:
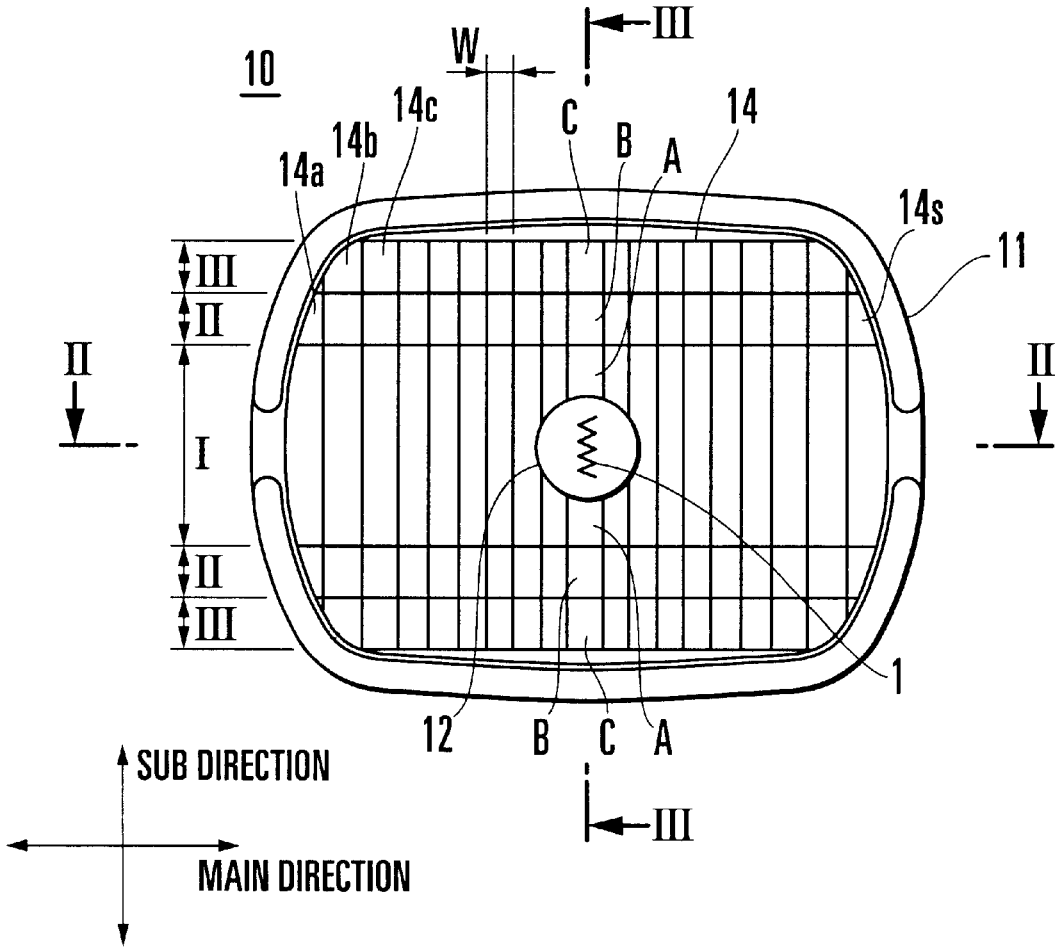
FIG. 1 is a front view of a reflecting mirror for an astral lamp according to the first embodiment of the present invention.
Figure 2A:
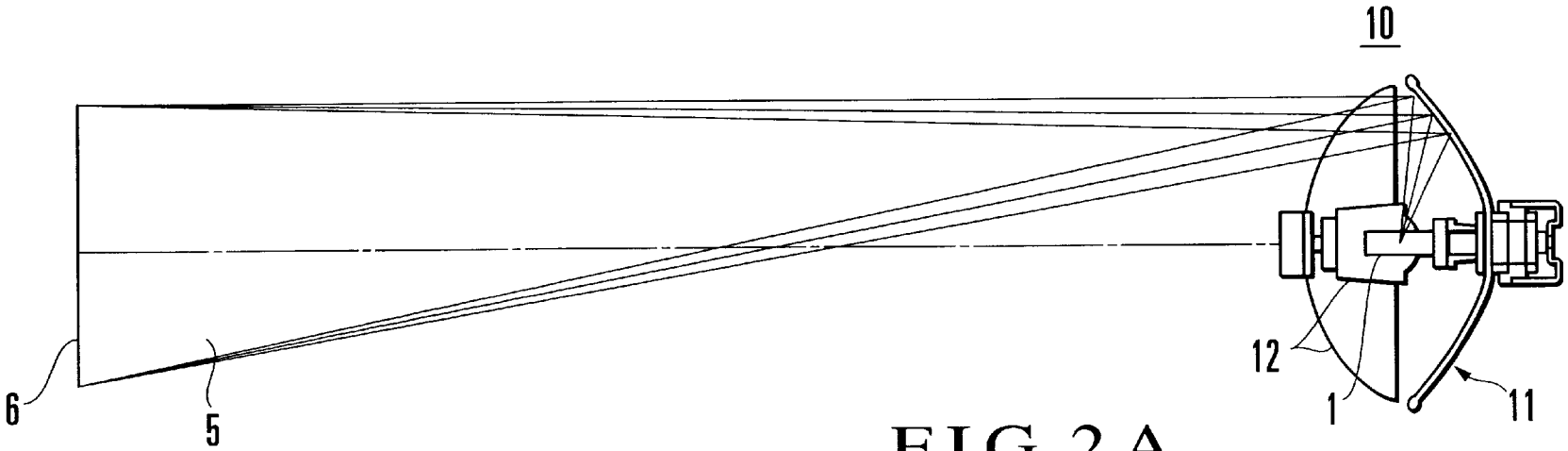
FIG. 2A is a sectional view taken along the line II—II of FIG. 1.
Figure 2B:
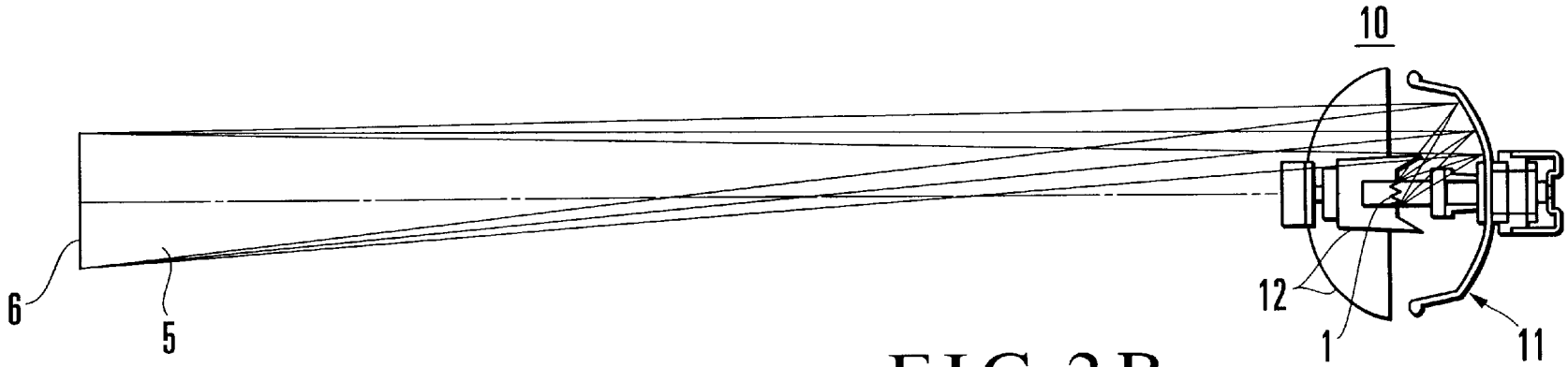
FIG. 2B is a sectional view taken along the line III—III of FIG. 1.
Figure 3A:
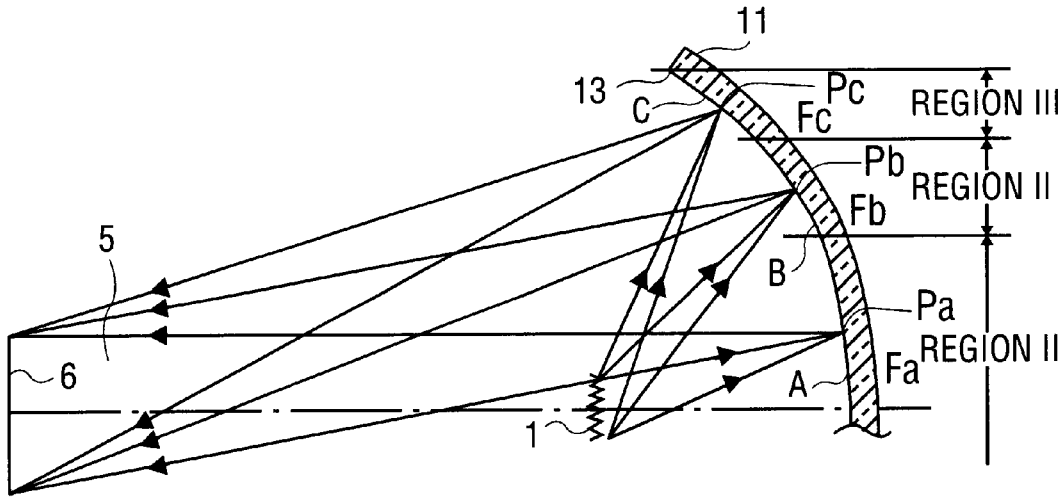
FIG. 3A is a view for explaining angles formed by direct incident light beams and reflected light beams.
Figure 3B:
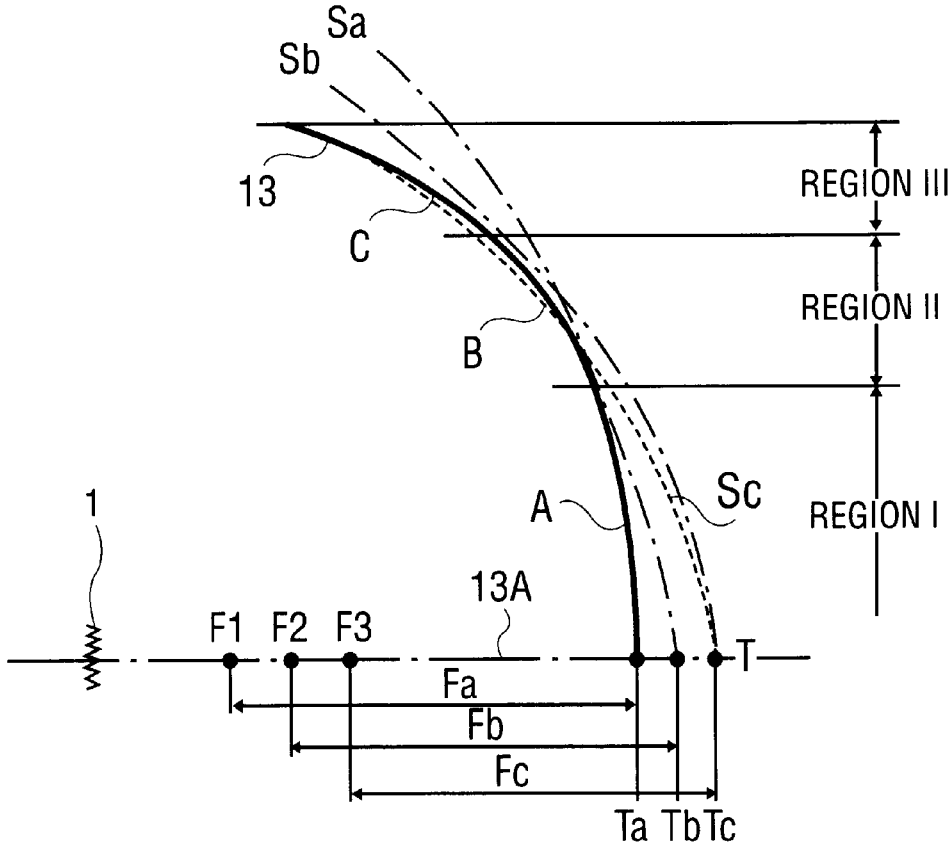
FIG. 3B is a detailed view of FIG. 3A.
Figure 5:
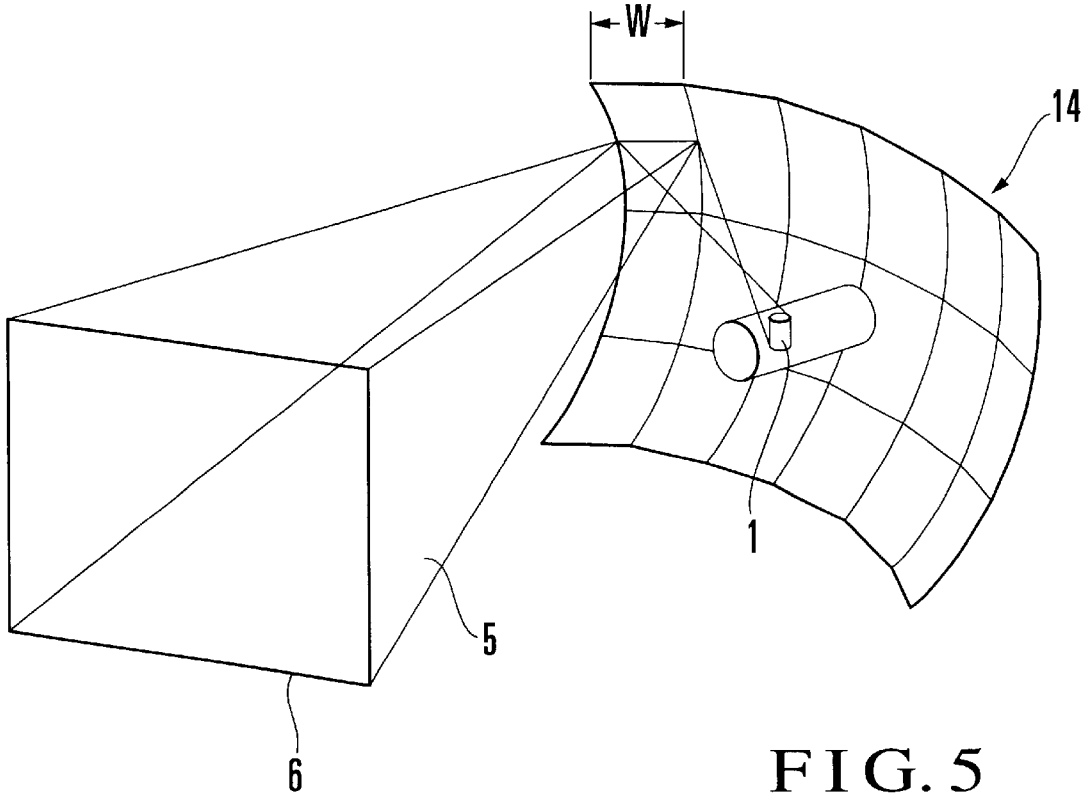
FIG. 5 is a perspective view showing part of a mirror surface and its illumination area.
Figure 26:
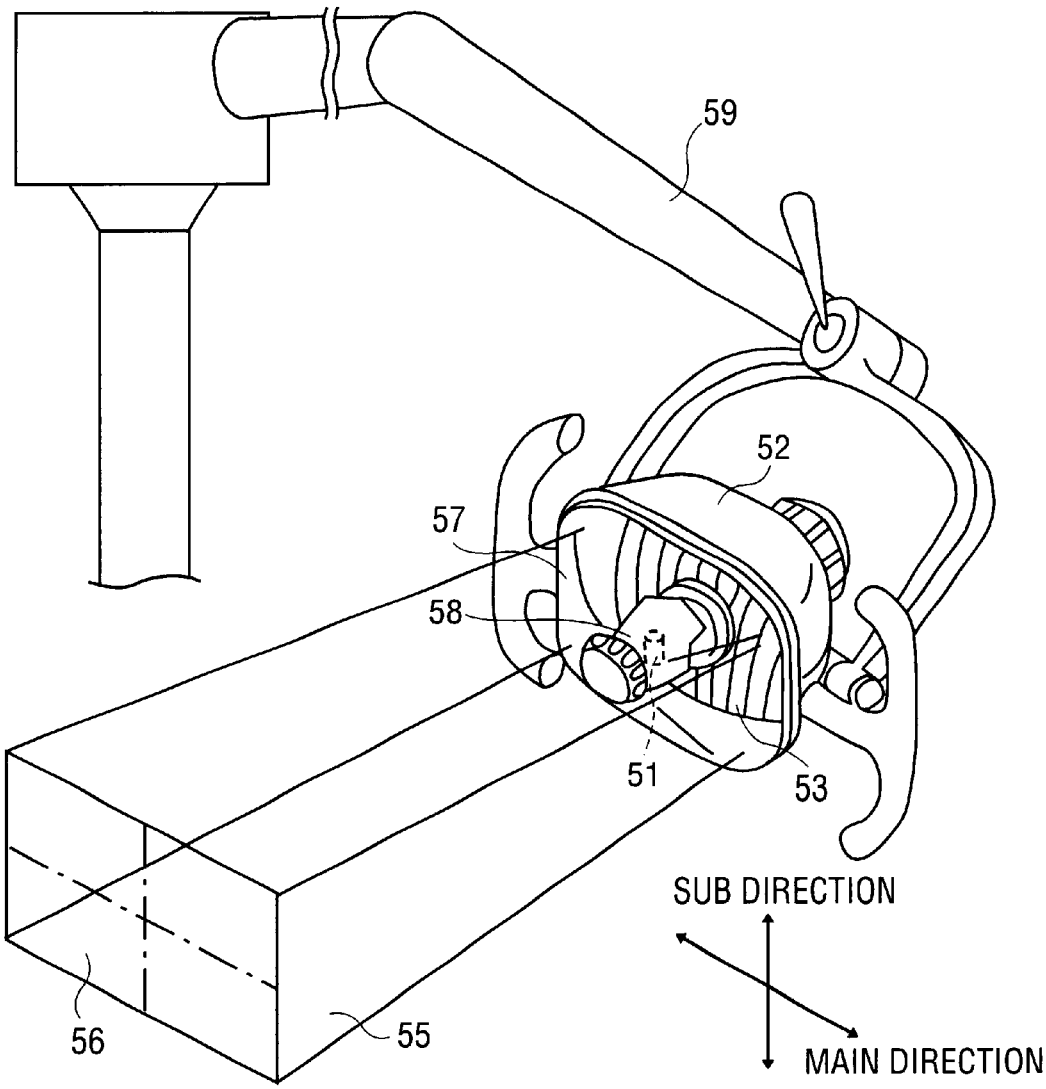
FIG. 26 (PRIOR ART)
FIG. 26 is a view explaining a generally used astral lamp.
Figure 27:
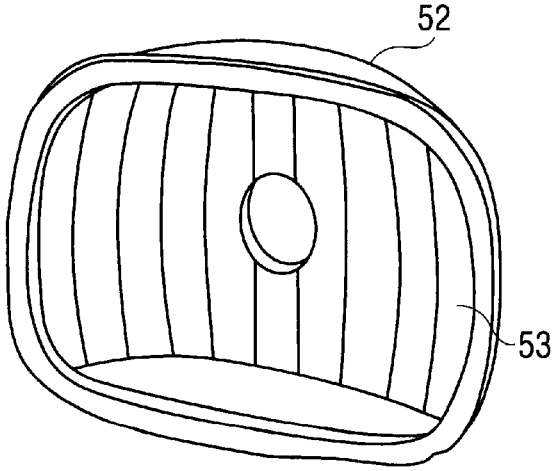
FIG. 27 is a view showing the outer appearance of a conventional reflecting mirror.
Figure 28:
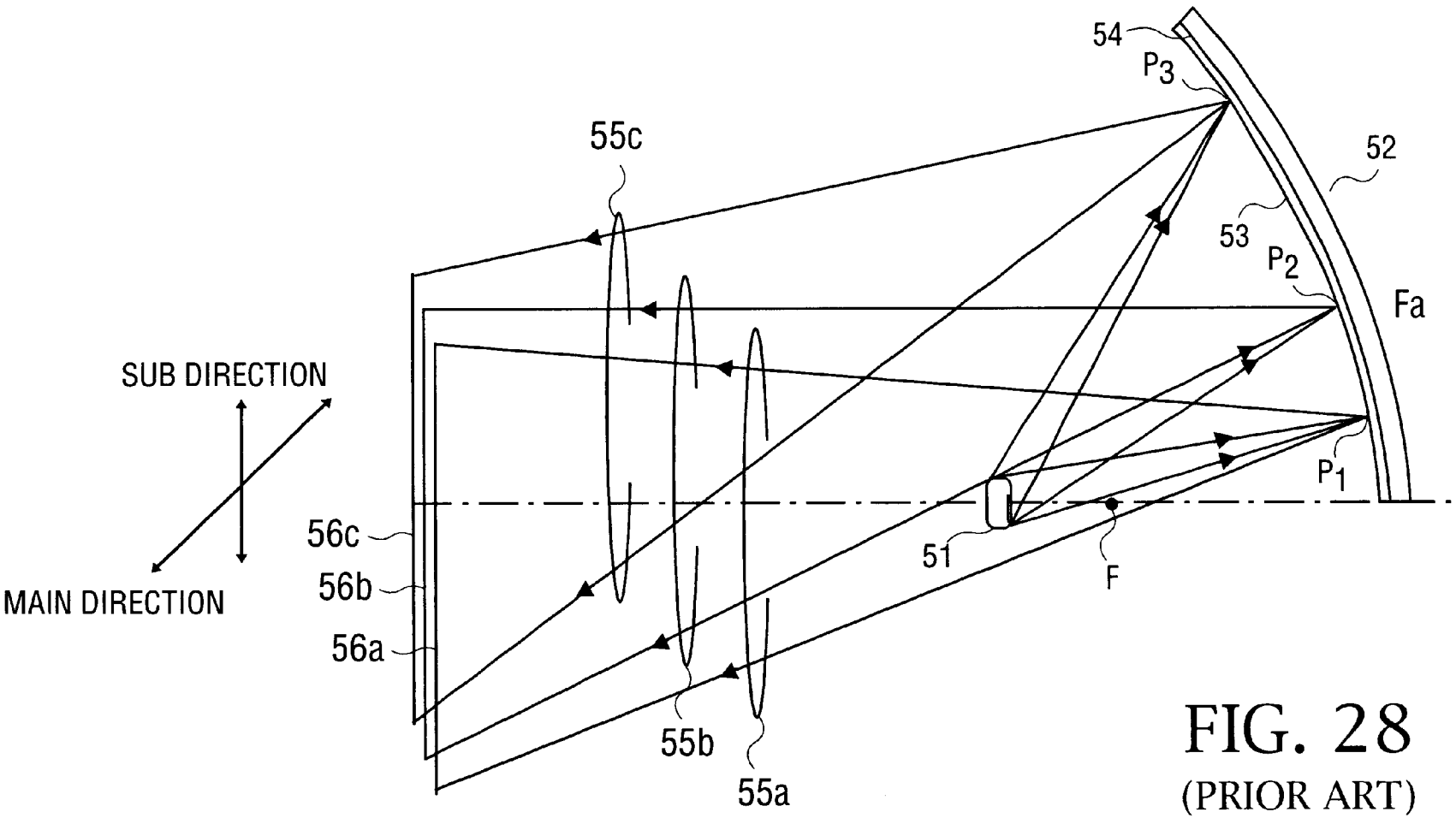
FIG. 28 (PRIOR ART)
FIG. 28 is a view showing angles of incidence and reflection of beams in a conventional reflecting mirror for an astral lamp.

FIG. 1 shows the reflecting mirror of an astral lamp according to the first embodiment of the present invention. FIGS. 2A and 2B show this reflecting mirror in section. FIGS. 3A and 3B show angles formed by direct incident light beams and reflected light beams. FIG. 5 shows some segments and the illumination area of a light path. Referring to FIGS. 1, 2A and 2B, 3A and 3B, and 5, a reflecting mirror 10 for an astral lamp is constituted by a parabolic mirror 11 of revolution, a linear light source 1, a transparent cover 12, and the like. The parabolic mirror 11 is made of heat-resistant glass or the like. The linear light source 1 is arranged in front of the parabolic mirror 11. The cover 12 shields direct incident light emitted by the linear light source 1. The reflecting mirror 10 is supported by an arm (not shown) in the same manner as in FIG. 26 described above.

The parabolic mirror 11 is formed into a horizontally elongated rectangle having major and minor axes when seen from the front, and forms a concave mirror 13, the inner surface of which forms a concave curved surface toward the central portion. The concave mirror 13 is comprised of a plurality of concave mirror surfaces forming one parabolic mirror of revolution as a whole. Each mirror surface has a curved surface for reflecting light emitted by the linear light source 1 toward an entire illumination area 6 and condensing the reflected light. In the example of FIG. 1, the concave mirror 13 is divided into a plurality of segments 14 (14*a*, 14*b*, 14*c*, . . . , 14*s*) each having an appropriate width W in the main direction and divided into a region I, regions II, and regions III in the subdirection. The respective regions form mirror surfaces A, B, and C in accordance with a conventionally known technique such as vapor deposition. In the following description, the horizontal direction of the concave mirror 13 will be referred to as the main direction, and the vertical direction perpendicular to it will be referred to as the subdirection. In FIG. 1, the main direction of the concave mirror 13 corresponds to the major axis, and the subdirection thereof corresponds to the minor axis. However, the main direction and subdirection may be set in any directions.

As shown in FIG. 3B, the mirror surfaces A, B, and C formed on the segments 14 are formed in a concave manner with respect to auxiliary curved surfaces Sa, Sb, and Sc having different focal lengths Fa, Fb, and Fc (Fa>Fb>Fc) along a predetermined direction, in this case, the subdirection. The auxiliary curved surfaces Sa, Sb, and Sc have focal points on a mirror axis 13A of the concave mirror 13 and are arranged to be curved in the same direction as the concave mirror 13. The mirror surface A that is the closest to the linear light source 1 is formed with reference to the auxiliary curved surface Sa, having the longest focal length Fa, to be curved with respect to the auxiliary curved surface Sa along a predetermined direction, the subdirection in this case (i.e., along the long side of the segments 14).

The mirror surfaces C that are the farthest from the linear light source 1 are formed with reference to the auxiliary curved surface Sc, having the shortest focal length Fc, to be curved with respect to the auxiliary curved surface Sc along the subdirection. The intermediate mirror surfaces B are formed with reference to the auxiliary curved surface Sb, having the intermediate focal length Fb, to be curved with respect to the auxiliary curved surface Sb along the subdirection. These mirror surfaces A, B, and C are formed flat in the main direction perpendicular to the subdirection. Each auxiliary curved surface may be any curved surface as far as it is a curved surface having a focal point, and can be, other than a paraboloid of revolution formed by rotating a predetermined parabola, an elliptic paraboloid or hyperboloid.

Each segment 14 has such a width W that it can irradiate a reflected light beam corresponding to the long width of the illumination area 6 of a light path 5.

The linear light source 1 is comprised of a linear halogen lamp, krypton lamp, or the like, and is arranged such that the longitudinal direction of its filament coincides with the subdirection of the concave mirror 13, and to be located in front of the focal point of the concave mirror 13.

In this manner, in this embodiment, the concave mirror 13 of the parabolic mirror 11 is constituted by the plurality of concave mirror surfaces A, B, and C formed in each of the segments 14*a*, 14*b*, 14*c*, . . . , and 14*s* divisionally along the long sides. The respective mirror surfaces reflect light emitted by the linear light source 1 toward the entire illumination area 6 and condense the reflected light. Since the curved surfaces of the respective mirror surfaces are set separately, an illumination area having a desired width narrower than the width of the parabolic mirror of revolution in the subdirection can be obtained, and the reflected light beams can be condensed toward the illumination area at high precision, satisfying the two requirements simultaneously.

Therefore, when compared to a conventional case wherein the parabolic mirror of revolution is formed of one fundamental paraboloid so, light emitted by the linear light source 1 can be separately condensed toward the desired illumination area 6 highly efficiently without causing a positional error in the illumination area. As a result, a shadow image of the linear light source 1 or a light-shielding object such as a hand is not formed in the light path 5, so that a high shadowless degree can be obtained, and the illumination area 6 can be irradiated at a higher illumination uniformity. A mirror surface forming method is not limited to the above description, but various types of forming methods may be possible.

As shown in FIG. 3B, the mirror surfaces A, B, and C are formed with reference to either one of the auxiliary curved surfaces Sa, Sb, and Sc having the different focal lengths. Therefore, a curved surface that reflects light emitted by the linear light source 1 toward the illumination area 6 at high precision can be set easily in each mirror surface. A mirror surface closer to the linear light source 1, i.e., closer to the concave mirror 13, in the subdirection uses an auxiliary curved surface having a longer focal length. Therefore, when compared to the conventionally used one fundamental paraboloid So, a mirror surface closer to the mirror axis of the concave mirror 13 can form a larger angle, i.e., a larger angle of inclination, with the mirror axis and the mirror surface. Even when the linear light source 1 is arranged perpendicularly to the mirror axis 13A, the vertical positional error of the illumination area 6 can be decreased greatly. The focal length of the auxiliary curved surface to which each mirror surface refers may be continuously changed among the respective mirror surfaces, or may be changed stepwise among groups each formed by a plurality of mirror surfaces.

The mirror surfaces A, B, and C are formed to be curved in only one direction, i.e., the subdirection in this case, and to be linear in the main direction. Accordingly, the section of each mirror surface forms an arcuate short strip, so that each mirror surface can reduce reflected light toward the illumination area 6 in only a desired direction. Since the widths of the mirror surfaces A, B, and C in a predetermined direction, i.e., the main direction in this case, are set equally when seen from the front, an illumination area 6 having a width substantially equal to them in this direction can be obtained easily.

In FIGS. 3A and 3B, vertices Ta, Tb, and Tc of the respective auxiliary curved surfaces are shifted on the mirror axis 13A so that the auxiliary curved surfaces Sa, Sb, and Sc intersect each other on the boundaries among the mirror surfaces A, B, and C. The mirror surfaces A, B, and C are thus continuous through these boundaries to form the smooth concave mirror 13, so that they can condense light uniformly toward the illumination area 6.

Figure 4A:
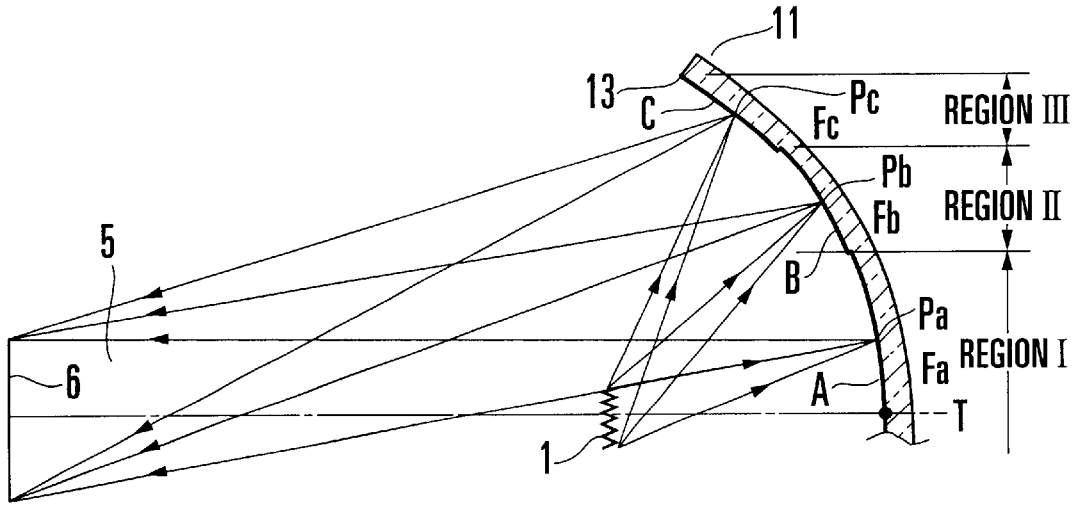
FIG. 4A is another view for explaining angles formed by direct incident light beams and reflected light beams.
Figure 4B:
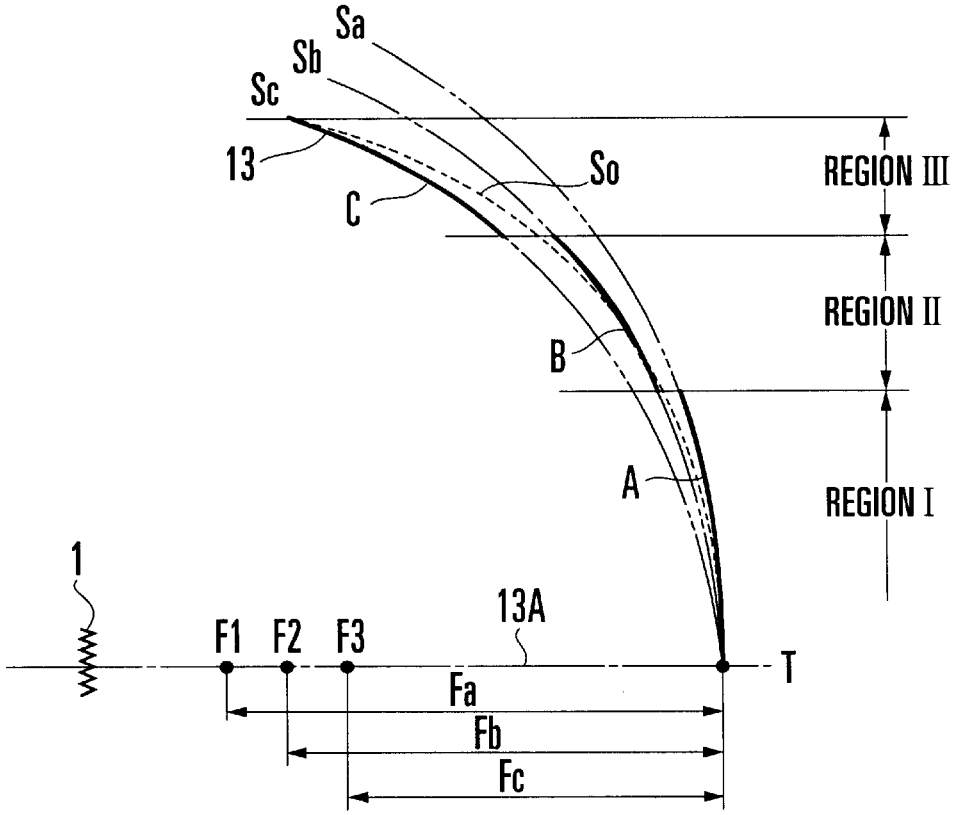
FIG. 4B is a detailed view of FIG. 4A.

Regarding this, as shown in FIGS. 4A and 4B, the respective auxiliary curved surfaces may be arranged such that their vertices are located at one position T on the mirror axis 13A. In this case, a mirror surface closer to the mirror axis of the concave mirror 13 can form a larger angle of inclination, and can have a longer distance from the linear light source 1, when compared to the case of FIGS. 3A and 3B. Therefore, in the case of FIGS. 4A and 4B, in a mirror surface close to the mirror axis of the concave mirror 13, the divergent angle of the light emitted by the linear light source 1 to become incident on the mirror surface is decreased. A difference in divergent angle decreases through all the regions of the concave mirror 13 to reflect light from all the mirror surfaces toward the illumination areas at high precision. A further excellent light-condensing performance can be obtained with the whole concave mirror.

Figure 6:
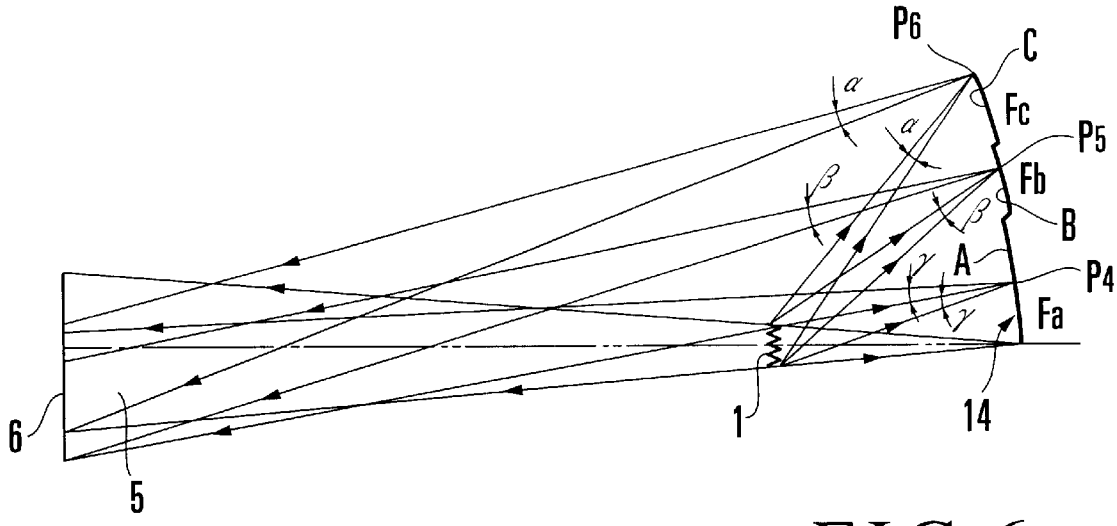
FIG. 6 is a view showing the angles of direct incident light beams obtained when the focal length of the mirror surface is smaller at a portion closer to the central portion.

In the embodiment described above, the mirror surfaces A, B, and C along the long sides of the segments 14 are formed such that their focal lengths increase toward the center, and the linear light source 1 is arranged such that its longitudinal direction coincides with the minor-axis direction of the concave mirror 13. However, the present invention is not limited to this, and the focal lengths of the mirror surfaces A, B, and C along the long sides of the segments 14 may increase from the center toward the outer sides. If the linear light source 1 is arranged along the subdirection of the fundamental paraboloid, as shown in FIG. 6, the closer to the central beam, the closer to the linear light source 1.

Therefore, angles $\gamma$, $\beta$, and $\alpha$ (or the angles of reflected light beams) of direct incident light beams that come incident on arbitrary points P4, P5, and P6 of the respective portions A, B, and C do not become substantially equal to each other ($\gamma<\beta<\alpha$), and the reflected light beams are shifted downward to enlarge the illumination area 6 of the light path 5. In this case, assuming that the illumination area irradiated by the portion A having the focal length Fa is defined as the reference, the reflected light beams reflected by other portions B and C are shifted downward, and a high illumination uniformity cannot accordingly be obtained. However, no problem arises as far as this reflecting mirror is used as a reflecting mirror for an astral lamp which has a high central luminous intensity.

Figure 7:
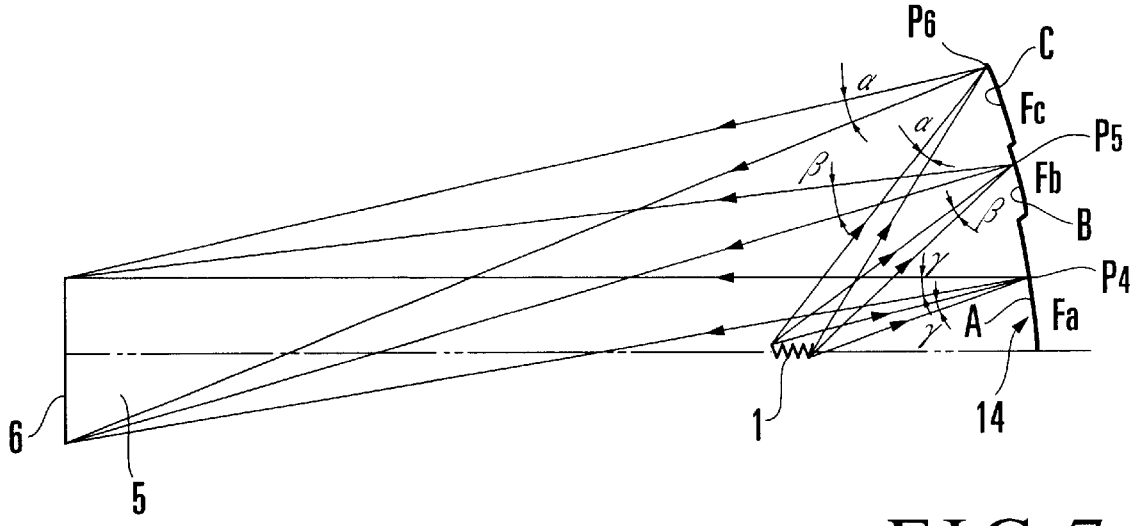
FIG. 7 is a view showing the angles of direct incident light beams according to the second embodiment of the present invention.

As shown in the second embodiment shown in FIG. 7, when a linear light source 1 is arranged along the optical axis of a fundamental paraboloid, angles $\gamma$, $\beta$, and $\alpha$ (or the angles of reflected light beams) of direct incident light beams that come incident on arbitrary points P4, P5, and P6 of respective portions A, B, and C can be made substantially equal to each other ($\gamma\approx\beta\approx\alpha$). Therefore, the light beams reflected by the points P4, P5, and P6 are not shifted downward and can uniformly irradiate the whole region of an illumination area 6 in the vertical direction. When the linear light source 1 is arranged along a mirror axis 13A, no shadow image is formed in the illumination area 6 even when the linear light source 1 or a light-shielding object such as a hand enters a light path 5, so that a high shadowless degree can be obtained. When the shadowless degree is increased, the luminous intensity of the whole illumination area of the light path 5 becomes uniform, so that a higher illumination uniformity can be obtained.

Figure 8:
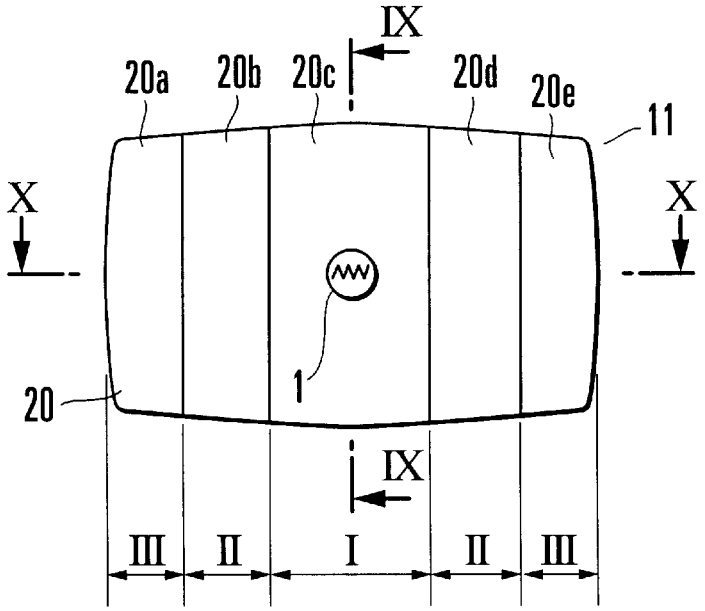
FIG. 8 is a front view of a reflecting mirror for an astral lamp according to the third embodiment of the present invention.
Figure 9:
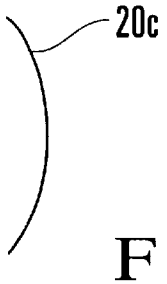
FIG. 9 is a sectional view taken along the line IX—IX of FIG. 8.
Figure 10:
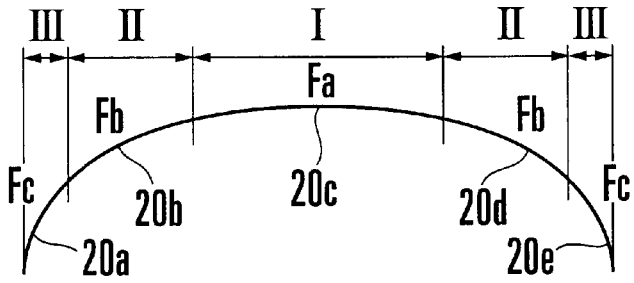
FIG. 10 is a sectional view taken along the line X—X of FIG. 8.
Figure 11:
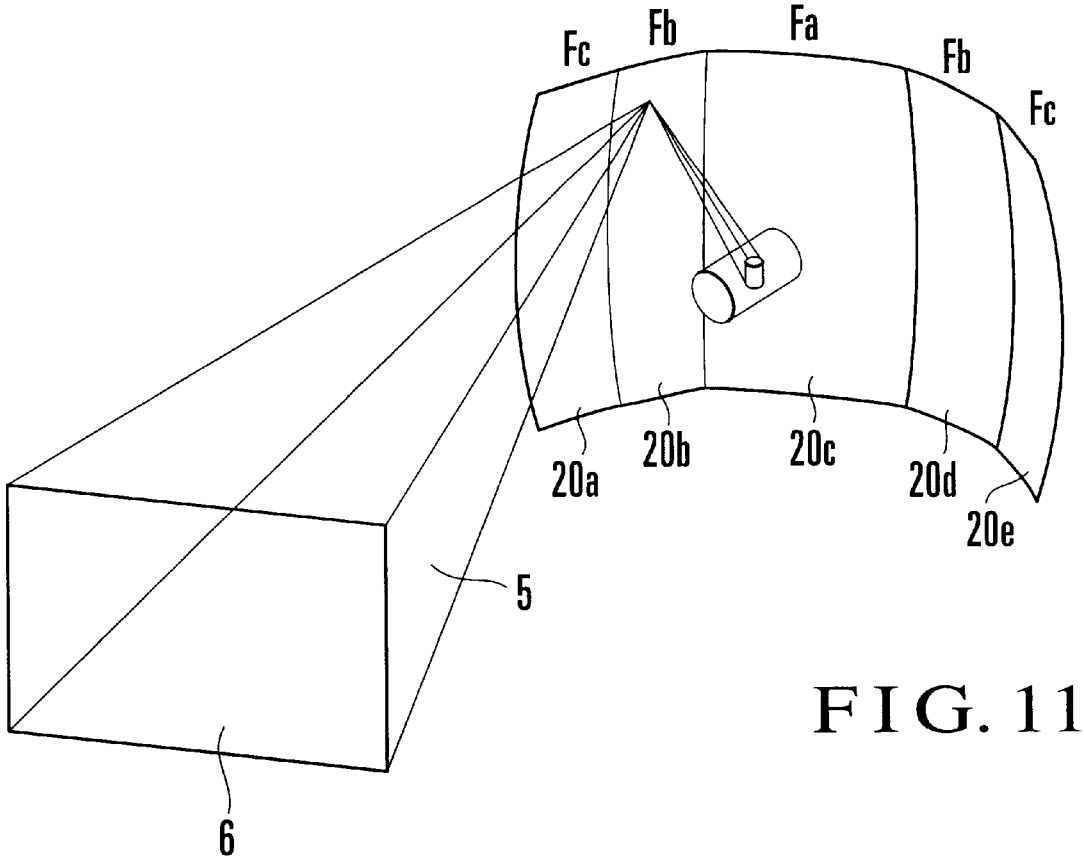
FIG. 11 is a schematic perspective view showing a mirror surface and the illumination area of an irradiation turn.

FIG. 8 shows a reflecting mirror for an astral lamp according to the third embodiment of the present invention. FIGS. 9 and 10 show the reflecting mirror of FIG. 8 in section. FIG. 11 shows mirror surfaces and an illumination area of a light path. In the third embodiment, the concave curved surface (concave mirror 13) of a parabolic mirror 11 of revolution is divided into three regions I, II, and III in the main direction, and the respective regions form five mirror surfaces 20 (20*a* to 20*e*) for reflecting light, emitted by a linear light source 1 arranged along the main direction, toward a predetermined illumination area 6. The mirror surfaces 20*a* to 20*e* form rectangular parabolic mirrors respectively having short sides coinciding with the widths of the regions I, II, and III divided in the main direction of the concave curved surface, and long sides coinciding with the subdirection of the concave curved surface.

The mirror surfaces 20*a* to 20*e* are formed to be curved in the subdirection along predetermined curved surfaces. Also, the mirror surfaces 20*a* to 20*e* are formed such that one closer to the center of the concave curved surface is curved, with reference to an auxiliary curved surface having a larger focal length, along the main direction. Hence, the focal lengths of the mirror surfaces 20*a* and 20*e* on two sides are Fc, the focal lengths of the mirror surfaces 20*b* and 20*d* inside the mirror surfaces 20*a* and 20*e* are Fb, and the focal length of the central mirror surface 20*c* is Fa (Fa>Fb>Fc). The focal lengths of the respective mirror surfaces 20*a* to 20*e* differ accordingly, and a mirror closer to the center of the concave mirror has a larger focal length.

In this arrangement, the concave mirror surfaces 20*a* to 20*e*, the focal lengths of which increase as they are closer to the center in the main direction, are formed, and a mirror surface closer to the center can have a larger angle of inclination. As a result, in the same manner as in the first embodiment shown in FIG. 1, light emitted by the linear light source 1 and reflected by the mirror surfaces 20*a* to 20*e* can be condensed toward the desired illumination area 6 at high precision, and a shift in illumination area particularly in the main direction can be greatly decreased. Since the mirror surfaces 20*a* to 20*e* are curved in the subdirection as well, when compared to a case using mirror surfaces curved in one direction, light can be condensed further efficiently. In this embodiment, the linear light source 1 is arranged along the main direction. However, the present invention is not limited to this, but may be arranged along the subdirection.

Figure 12:
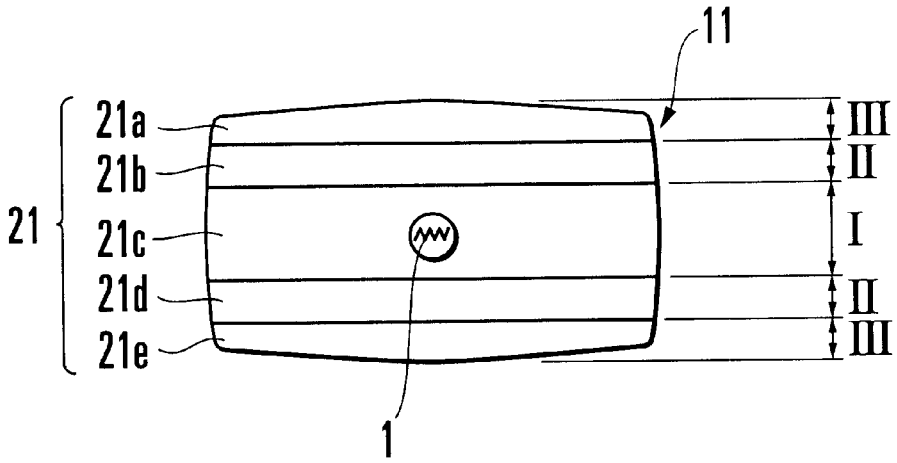
FIG. 12 is a front view of a reflecting mirror for an astral lamp according to the fourth embodiment of the present invention.
Figure 13:
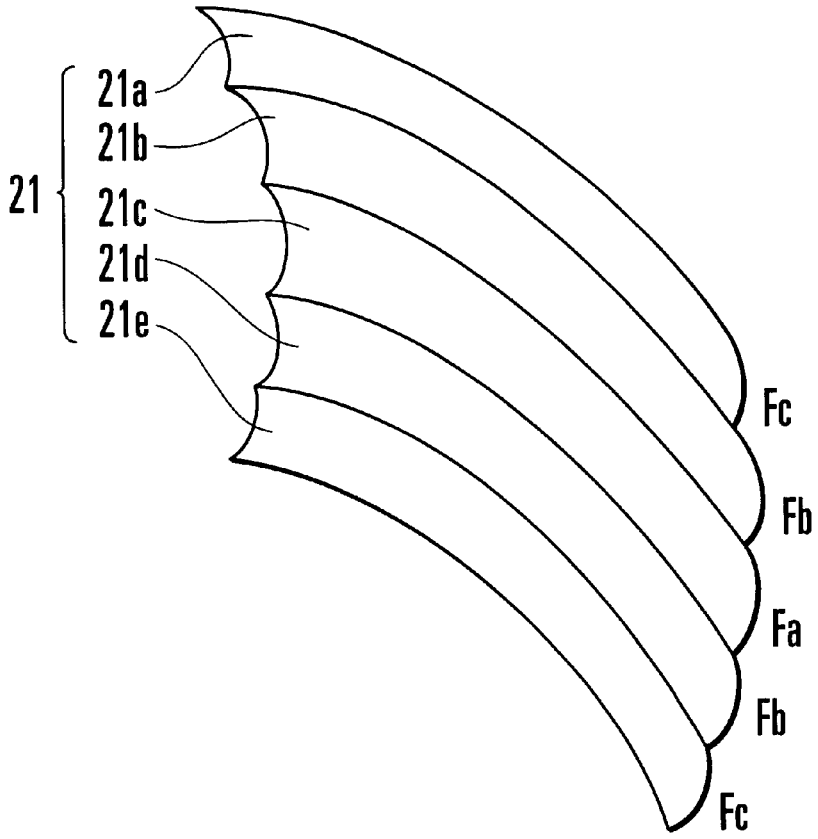
FIG. 13 is a perspective view of a mirror surface.

FIG. 12 shows a reflecting mirror for an astral lamp according to the fourth embodiment of the present invention, and FIG. 13 shows mirror surfaces. In the fourth embodiment, the concave curved surface (concave mirror 13) of a parabolic mirror 11 of revolution is divided into three regions I, II, and III in the subdirection, and the respective regions form five mirror surfaces 21 (21*a* to 21*e*) for reflecting light emitted by a linear light source 1 toward a predetermined illumination area 6. The mirror surfaces 21*a* to 21*e* form rectangular parabolic mirrors respectively having short sides coinciding with the widths of the regions I, II, and III divided in the subdirection of the concave curved surface, and long sides coinciding with the main direction of the concave curved surface.

The mirror surfaces 21*a* to 21*e* are formed to be curved in the main direction along predetermined curved surfaces. Also, the mirror surfaces 21*a* to 21*e* are formed such that one closer to the center of the concave curved surface is curved, with reference to an auxiliary curved surface having a larger focal length, along its subdirection. Hence, the focal length of the respective mirror surface 21*c* located at the center of the concave curved surface is Fa, the focal lengths of the mirror surfaces 21*b* and 21*d* located above and below the mirror surface 21*c* are Fb, and the focal lengths of the mirror surfaces 21*a* and 21*e* at the highest and lowest stages are Fc (Fa>Fb>Fc). The focal lengths of the respective mirror surfaces 21*a* to 21*e* differ accordingly, and a mirror surface closer to the center of the concave mirror has a larger focal length. Although the linear light source 1 is arranged along the main direction of the concave mirror, it may be arranged along the subdirection.

In this structure, the concave mirror surfaces 21*a* to 21*e*,the focal lengths of which increase as they are closer to the center in the subdirection, are formed, so that a mirror surface closer to the center can have a larger angle of inclination. As a result, in the same manner as in the first and third embodiments shown in FIGS. 1 and 8, light emitted by the linear light source 1 and reflected by the mirror surfaces 21*a* to 21*e* can be condensed toward a desired illumination area at high precision, and a shift in illumination area particularly in the subdirection can be greatly decreased. Since the mirror surfaces 21*a* to 21*e* are curved in the main direction as well, when compared to a case using mirror surfaces curved in one direction, light can be condensed further efficiently.

Figure 14:
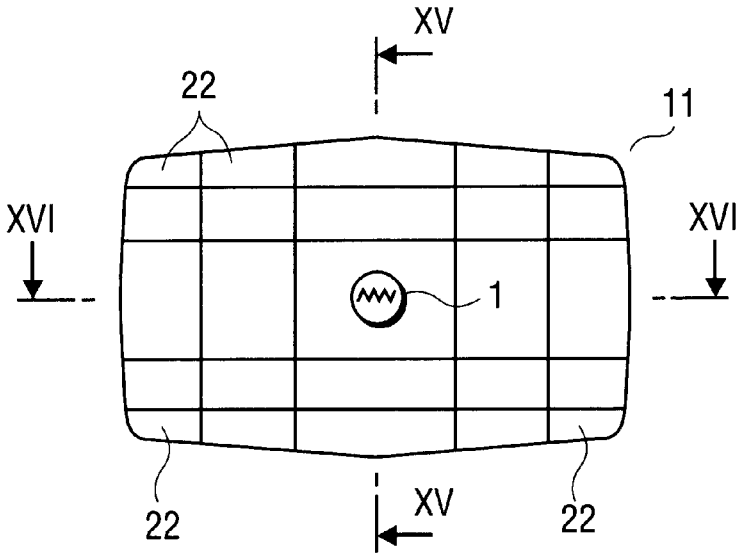
FIG. 14 is a front view of a reflecting mirror for an astral lamp according to the fifth embodiment of the present invention.
Figure 15:
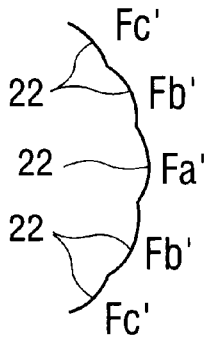
FIG. 15 is a sectional view taken along the line XV—XV of FIG. 14.
Figure 16:
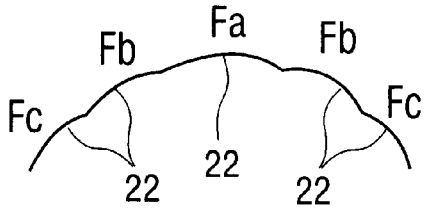
FIG. 16 is a sectional view taken along the line XVI—XVI of FIG. 14.
Figure 17:
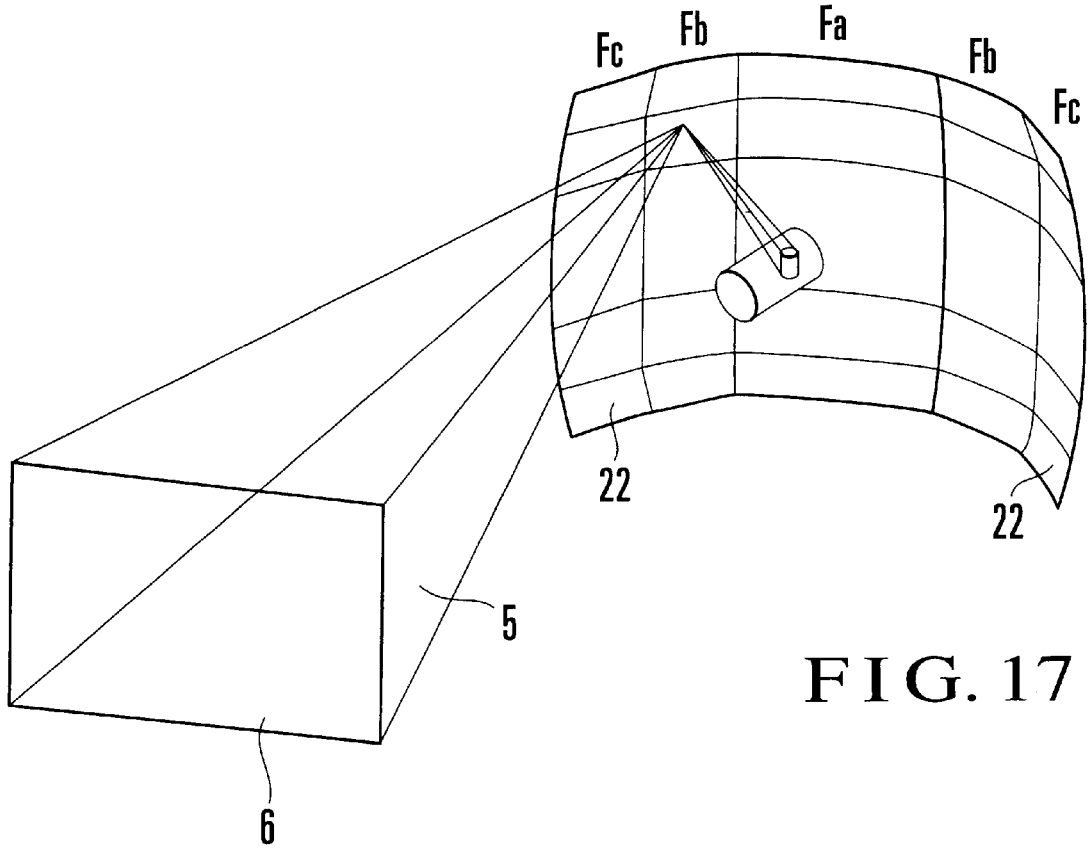
FIG. 17 is a perspective view showing a mirror surface and the illumination area of a light path.

FIG. 14 shows a reflecting mirror for an astral lamp according to the fifth embodiment of the present invention, FIGS. 15 and 16 show the reflecting mirror of FIG. 14 in section, and FIG. 17 shows mirror surfaces and the illumination area of a light path. In the fifth embodiment, the concave curved surface (concave mirror 13) of a parabolic mirror 11 of revolution is divided into a plurality of regions in the main direction and subdirection, an d the respective regions form a plurality of mirror surfaces 22 for reflecting light emitted by a linear light source 1 toward a predetermined illumination area 6. The mirror surfaces 22 have rectangular shapes identical to those of the respective regions of the concave mirror, and form a concave mirror formed of a spherical surface or a paraboloid.

The focal lengths of the respective mirror surfaces 22 differ, and a mirror surface closer to the center of the concave mirror has a larger focal length. The focal lengths of the mirror surfaces 22 are respectively Fa, Fb, and Fc (Fa>Fb>Fc) from the central mirror surface to the peripheral mirror surfaces in the main direction, and Fa', Fb', and Fc' (Fa'>Fb'>Fc') in the subdirection. Although the linear light source 1 is arranged along the main direction of the concave mirror, it may be arranged along the subdirection. The focal lengths Fa and Fa' in the main direction and subdirection of the mirror surface located near the center of the concave mirror may have the same value (Fa=Fa').

In the reflecting mirror for the astral lamp which has this structure, the focal lengths of the respective mirror surfaces 22 are differed such that one closer to the center of the concave mirror has a larger focal length. Hence, a mirror surface closer to the center has a longer distance to the linear light source 1 and accordingly a larger angle of inclination. Therefore, in the same manner as in the first, third, and fourth embodiments shown in FIGS. 1, 8, and 12, light emitted by the linear light source 1 and reflected by the mirror surfaces 22 can be condensed toward a desired illumination area 6 at high precision, and a shift in illumination area particularly both in the main direction and subdirection can be greatly decreased. Since the respective mirror surfaces are curved both in the main direction and subdirection, when compared to a case using mirror surfaces curved in one direction, light can be condensed further efficiently.

Figure 18:
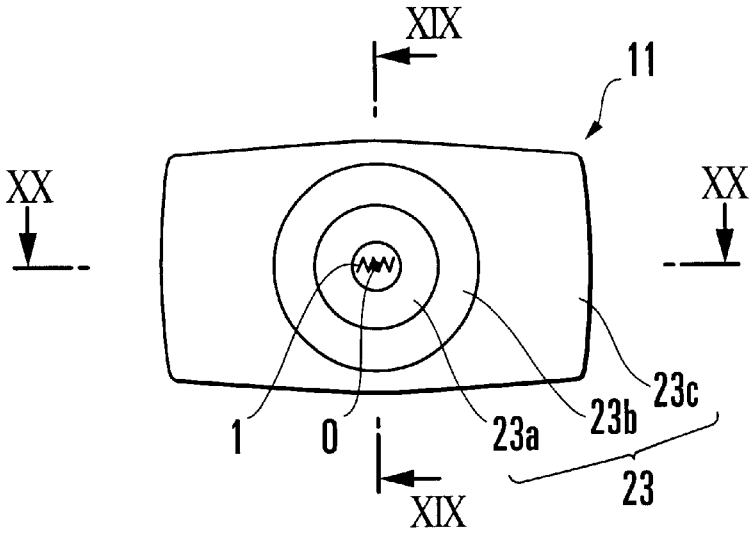
FIG. 18 is a front view of a reflecting mirror for an astral lamp according to the sixth embodiment of the present invention.
Figure 19:
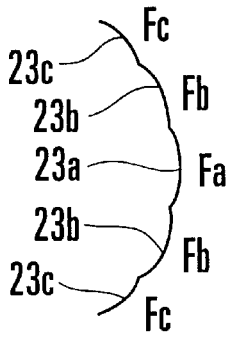
FIG. 19 is a sectional view taken along the line XIX—XIX of FIG. 18.
Figure 20:
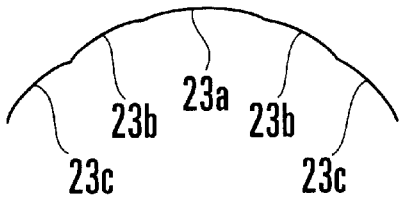
FIG. 20 is a sectional view taken along the line XX—XX of FIG. 18.
Figure 21:
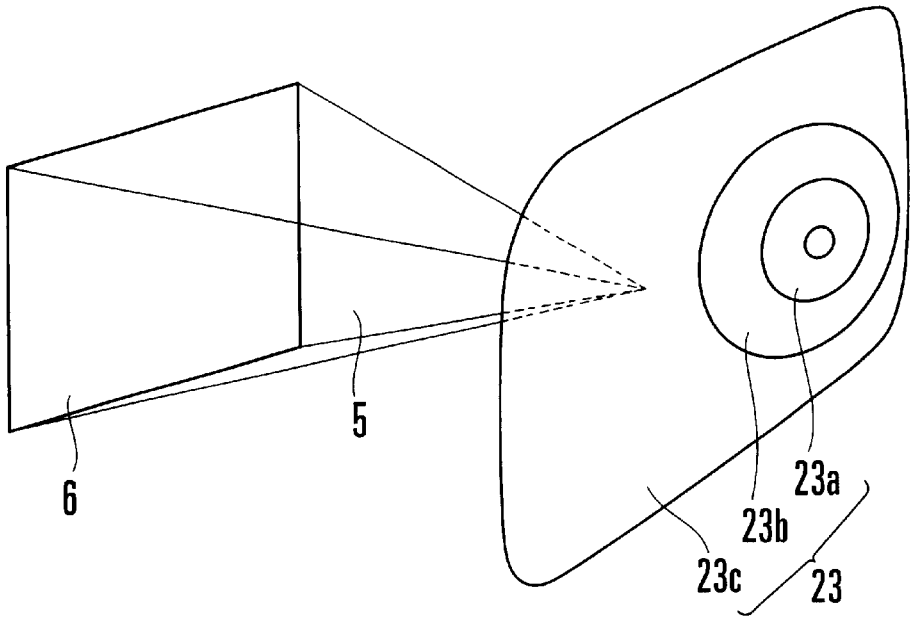
FIG. 21 is a perspective view showing a mirror surface and the illumination area of a light path.

FIG. 18 shows a reflecting mirror for an astral lamp according to the sixth embodiment of the present invention, FIGS. 19 and 20 show the reflecting mirror of FIG. 18 in section, and FIG. 21 shows mirror surfaces and the illumination area of a light path. In the sixth embodiment, the concave curved surface (concave mirror 13) of a parabolic mirror 11 of revolution is concentrically divided into three regions about a center O of the concave curved surface, and the respective regions form three mirror surfaces 23 (23*a* to 23*c*) for reflecting light emitted by a linear light source 1 toward a predetermined illumination area 6. Of the mirror surfaces 23*a* to 23*c*, the mirror surface 23*c* has a circular shape, the mirror surface 23*b* has a ring-like shape, and the mirror surface 23*c* has a circular hole at its center. The outer shape of the mirror surface 23*c* coincides with the outer shape of the parabolic mirror 11.

Figure 22:
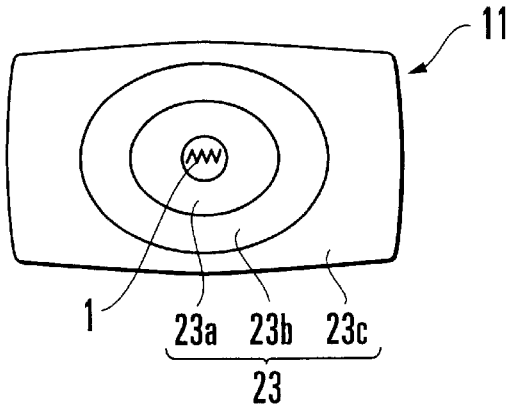
FIG. 22 is a front view of a reflecting mirror for an astral lamp according to the seventh embodiment of the present invention.
Figure 23:
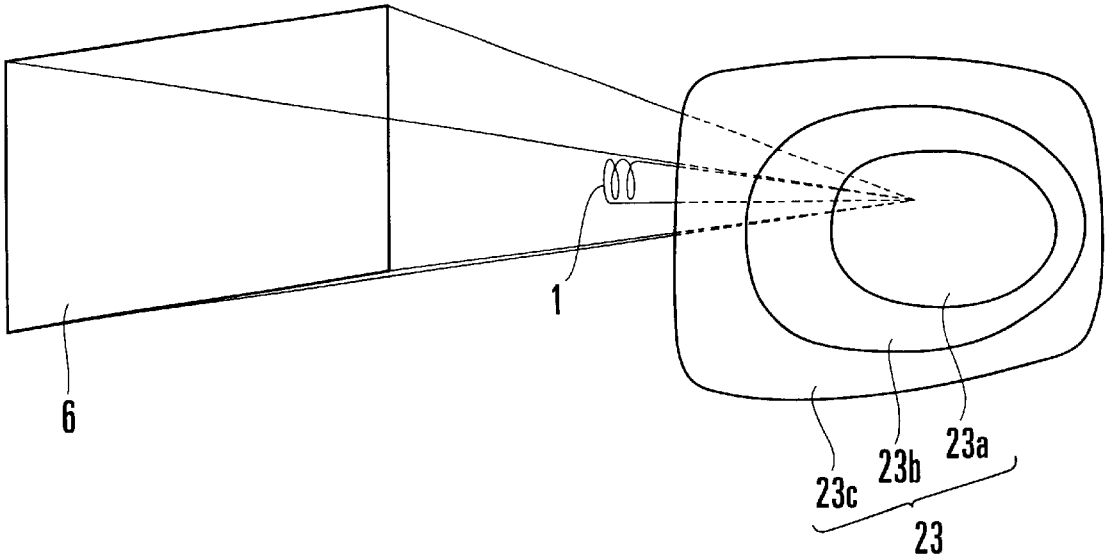
FIG. 23 is a perspective view showing a mirror surface and the illumination area of a light path.
Figure 24:
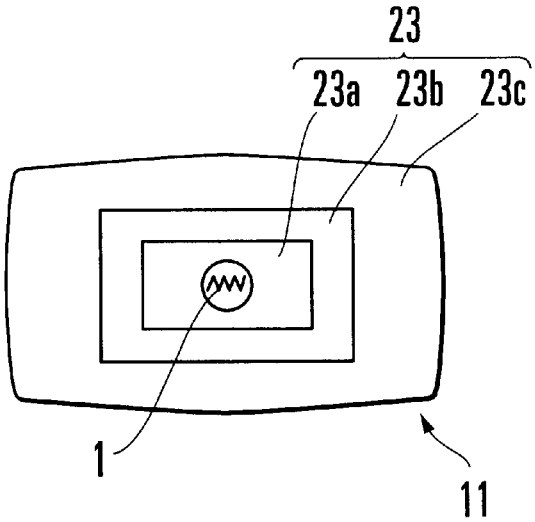
FIG. 24 is a front view of a reflecting mirror for an astral lamp according to the eighth embodiment of the present invention.
Figure 25:
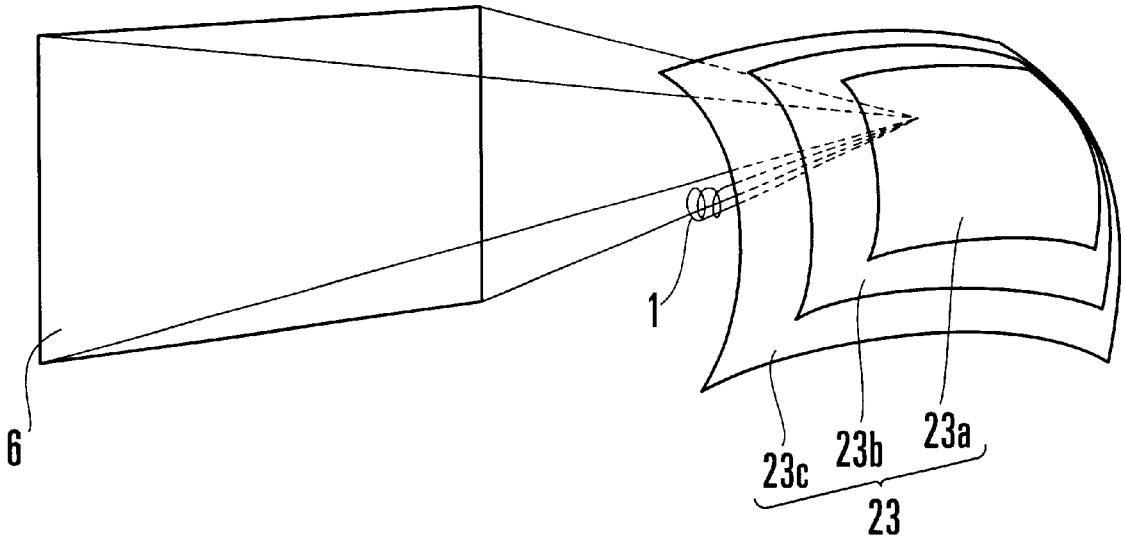
FIG. 25 is a perspective view showing a mirror surface and the illumination area of a light path.

The mirror surfaces 23*a* to 23*c* are formed such that one closer to the center of the concave curved surface is curved, with reference to an auxiliary curved surface having a larger focal length, along the radial direction (the direction of diameter) from the vertex (center) toward the peripheral portion. Of the mirror surfaces 23*a* to 23*c*, one closer to the center of the concave curved surface has a larger focal length. The mirror surfaces 23*a* to 23*c* may form an elliptic parabolic mirror of revolution, as in the seventh embodiment shown in FIGS. 22 and 23. Alternatively, the mirror surfaces 23*a* to 23*c* may form a rectangular shape having a long side coinciding with the main direction of the concave curved surface (concave mirror 13) of the parabolic mirror 11, in the same manner as in the eighth embodiment shown in FIGS. 24 and 25. Although the linear light source 1 is arranged along the main direction of the concave mirror, it may be arranged along the subdirection.

In this arrangement, the concave mirror surfaces 23*a* to 23*c*, the focal lengths of which increase as they are closer to the center, are formed, so that a mirror surface closer to the center can have a larger angle of inclination. In the same manner as in the first, third, fourth, and fifth embodiments shown in FIGS. 1, 8, 12, and 14, light emitted by the linear light source 1 and reflected by the mirror surfaces 23*a* to 23*c* can be condensed toward a desired illumination area at high precision. Therefore, a shadow image is not formed in the light path 5 having the predetermined illumination area 6 by the linear light source 1 or a light-shielding object such as a hand, and a high non-image degree can be obtained. Also, the illumination area 6 can be irradiated at a high illumination uniformity.

Although the mirror surfaces 14, 20, 21, 22, and 23 form paraboloids of revolution in the embodiments described above, they need not form complete paraboloids of revolution, but may form curved surfaces close to paraboloids of revolution.

Although the concave curved surface, i.e., the concave mirror 13, of the parabolic mirror 11 is defined into the three regions I, II and III having different focal lengths, they can be defined into four or more regions. The focal lengths are not limited to Fa, Fb, and Fc, and Fa', Fb', and Fc', but can be changed when necessary by design.

As has been described above, with the astral lamp according to the present invention, a plurality of concave mirror surfaces form the concave mirror of a parabolic mirror of revolution, and these mirror surfaces respectively reflect light emitted by the linear light source and condense the reflected light toward the entire portion of a desired illumination area. When the curved surfaces of the respective mirror surfaces are set separately, an illumination area having a desired width smaller than the width of the parabolic mirror of revolution in a predetermined direction (e.g., the subdirection) can be obtained, and the reflected light can be condensed toward the illumination area at high precision, satisfying two requirements simultaneously. Therefore, even when the linear light source or a light-shielding object enters the light path, a shadow image is not formed in the illumination area, thus improving the shadowless degree. When the shadowless decree is increased, the illumination area can be irradiated further uniformly to improve the illumination uniformity. Therefore, the present invention can be suitably used in dental and other medical treatments.

What is claimed is:

1. An astral lamp comprising a light source and a concave mirror for reflecting light emitted by said light source and condensing the reflected light on a-light source side toward an illumination area remote from said light source, said concave mirror being constituted by a plurality of concave mirror surfaces that form one parabolic mirror of revolution as a whole, said mirror surfaces respectively having curved surfaces for separately reflecting the light emitted by said light source and condensing the reflected light toward an entire portion of said illumination area, and wherein the mirror surfaces are arranged in a main direction and in a subdirection respectively, such that all the illumination by respective mirror surfaces are lighted up toward the same illumination area.

2. A lamp according claim 1, wherein said curved surfaces of said mirror surfaces are formed with reference to either one of a plurality of auxiliary curved surfaces arranged in the same direction as said concave mirror and wherein said curved surfaces are formed having focal points on a mirror axis of said concave mirror with different focal lengths to be curved with respect to said either one auxiliary curved surface along a predetermined direction.

3. A lamp according to claim 2, wherein said light source comprises a linear light source arranged on said mirror axis of said concave mirror along a direction perpendicular to said mirror axis, and a mirror surface closer to said light source has a curved surface formed with reference to an auxiliary curved surface having a longer focal length than a mirror surface remote from said light source.

4. A lamp according to claim 2, wherein said curved surfaces of said mirror surfaces are formed with reference to said auxiliary curved surfaces having different focal lengths that change continuously or stepwise at least in either one of a main direction and a subdirection of said concave mirror from a mirror surface closer to said light source to a mirror surface remote from said light source.

5. A lamp according to claim 1, wherein said curved surfaces of said mirror surfaces are formed to be curved at least in either one of a main direction and a subdirection of said concave mirror and have arcuate strip-shaped sections.

* * * * *

UNITED STATES PATENT AND TRADEMARK OFFICE

CERTIFICATE OF CORRECTION

PATENT NO. : 6,481,872 B1
DATED : November 19, 2002
INVENTOR(S) : Hayashi et al.

It is certified that error appears in the above-identified patent and that said Letters Patent is hereby corrected as shown below:

Column 11,
Line 31, please delete “on a-light source” and insert -- on a light source --.
Line 36, please delete “said mirror surfaces” and insert -- each of said mirror surfaces --.

Column 12,
Line 4, please delete “subdirection respectively” and insert -- subdirection of the concave mirror respectively --.
Line 9, please delete “of said” and insert -- of each said --.
Line 10, please delete “either” and insert -- a respectively --.
Line 14, please delete “lengths to” and insert -- lengths and to --.
Line 15, please delete “either” and insert -- respective --.
Lines 26 and 34, please delete “surfaces of said” and insert -- surfaces of each said --.

Signed and Sealed this

Thirtieth Day of November, 2004

JON W. DUDAS
*Director of the United States Patent and Trademark Office*